United States Patent [19]

Pries

[11] 3,933,598

[45] Jan. 20, 1976

[54] COKE OVEN DOOR

[75] Inventor: Erich E. Pries, Bochum, Germany

[73] Assignee: Dr. C. Otto & Comp. G.m.b.H., Bochum, Germany

[22] Filed: May 1, 1973

[21] Appl. No.: 356,086

[30] Foreign Application Priority Data

Feb. 23, 1973 Germany ..... 2309032

[52] U.S. Cl. ..... 202/248; 49/485

[51] Int. Cl.[2] ..... C10B 1/06; C10B 25/06

[58] Field of Search ..... 202/242, 247, 248, 262

[56] References Cited

UNITED STATES PATENTS

| | | | |
|---|---|---|---|
| 2,478,215 | 8/1949 | VanAckeren | 202/248 |
| 2,780,590 | 2/1957 | Doll | 202/248 |
| 2,800,435 | 7/1957 | Homan | 202/248 |
| 2,803,592 | 8/1957 | Shimazaki | 202/248 |
| 2,965,550 | 12/1960 | McClare | 202/248 |

FOREIGN PATENTS OR APPLICATIONS

| | | | |
|---|---|---|---|
| 4,129,645 | 12/1966 | Japan | 202/248 |

*Primary Examiner*—Norman Yudkoff
*Assistant Examiner*—D. Sanders
*Attorney, Agent, or Firm*—Brown, Murray, Flick & Peckham

[57] ABSTRACT

In a coke oven, a coke discharge opening communicating with the coking chamber is closed by a door which carries an angularly-shaped packing strip having an extended edge surface for engaging a door frame. The packing strip is adjustably supported by clamping plates attached to the door. The extended edge surface of the packing strip is resiliently urged at spaced locations about the periphery of the door by means of a spring-biased plunger carried by guide plates that are adjustably positioned on the door. The disclosure additionally provides stop plates at opposite sides of the door frame for engagement with adjustable bolts supported by the door for adjustably locating the door relative to the door frame.

6 Claims, 5 Drawing Figures

COKE OVEN DOOR

BACKGROUND OF THE INVENTION

This invention relates to a sealing arrangement for a coke oven door characterized by an angularly-shaped packing strip attached to the door and providing an extended edge for sealing engagement with a door frame and urged into contact therewith by resiliently-biased members supported by the door.

It is known in the art to form a metal-to-metal sealing arrangement between a coke oven door and a door frame therefor, by adjusting the sealing edge of a metal seal supported by the door by means of set screws distributed about the outer edge of the door. In another form, it is known to adjust the sealing edge of a door seal by means of draw bolts and set screws. The use of such sealing arrangements is brought about by the need to compensate for distortions of the door body and of the door frame due to the effects of thermal expansion and the unevenness of the metal parts which usually become encrusted with tar deposits that contribute further to the irregular shape of these parts. A circularly-shaped seal has been used in the past to extend into engagement with a coke oven door frame. The seal was attached to the sides of the door by frictional pressure developed by hook-like insertions on boths which projected through the sides of the door. In this arrangement, the sealing edge was adjusted to form a tight-fit throughout the entire periphery of the door frame by directing blows of a hammer upon the back edge of the seal.

Such known arrangements of parts for adjusting and fitting the sealing edge of a door to a door frame are not adequate to insure a tight closure by the oven door for oven chambers of great height. In this regard, deformations of the door and the frame occur to a greater extent as a result of distortions due to heat and tar deposits on the metal parts. It has been found that the tar deposits cannot always be avoided, notwithstanding mechanical cleaning of both the sealing edge and the door frame. These tar deposits have been observed to occur immediately after charging of coal into the oven chamber during which very high initial prevailing pressures in the chamber produce emissions of dense smoke at the oven door.

SUMMARY OF THE INVENTION

It is an overall object of the present invention to provide a packing strip for sealing a coke oven door to a door jamb when operatively positioned to form a closure for an opening to a coke oven chamber wherein the packing strip is adjustably positioned and urged under a resilient pressure into sealing contact with the door jamb.

It is a further object of the present invention to provide a packing strip with a sealing edge for coke oven doors which is adjustably supported by the door and resiliently urged toward a door frame so that the sealing edge extensively conforms to the deformations of metal parts of both the door and the frame while at the same time automatically adjusting the sealing edge contact pressure.

More specifically, according to the present invention, there is provided in a coke oven including a longitudinally-extending coke oven door, the combination with a door forming a closure for a coke discharge opening communicating with the oven chamber, the coke discharge opening being defined by a door frame located outwardly from the chamber, the combination including an angularly-shaped packing strip defining an edge surface adapted to extend into contact with the door frame, support means carried by the door for adjustably positioning on the packing strip such that the sealing edge surface lies extended from the door, clamping means including a resilient member for urging the edge surface at spaced locations on the door into engagement with the door frame when the door is positioned to define a closure for the coke discharge opening, and guide means carried by the door for suporting the clamping means.

These objects and advantages of the present invention as well as others will be more apparent when the following description is read in light of the accompanying drawings, in which.

Figure 1:
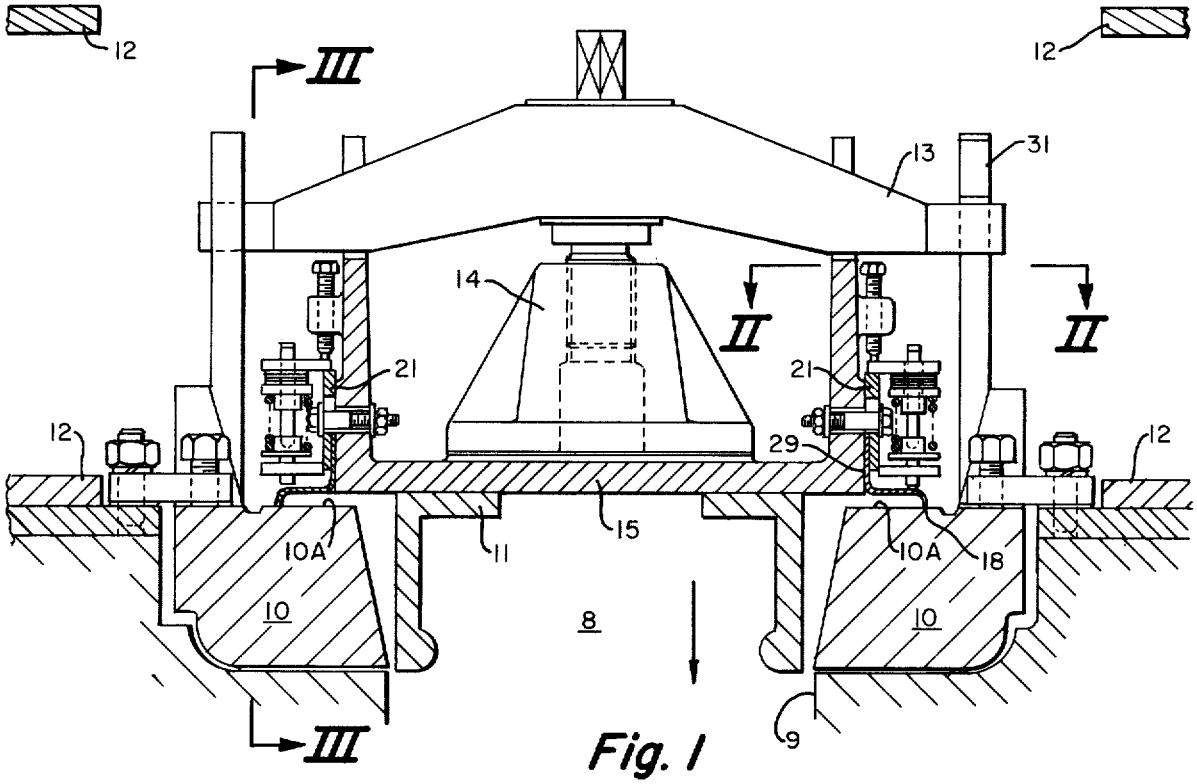
FIG. 1 is a sectional view taken horizontally through a coke oven door and a portion of an oven chamber illustrating the features of the present invention.

With reference now to FIG. 1, there is illustrated a horizontal section through a coke oven which includes an oven chamber 8 defined by vertical oven walls 9 that extend in a longitudinal direction indicated by the arrow in FIG. 1. A door frame 10 defines an opening communicating with the oven chamber. The door frame has a vertical face 10*a* outward from the coke oven chamber. A coke oven door 15 is constructed in the form of a generally U-shaped configuration. Attached to the coke facing wall of the door are holders 11 of a door stopper. The coke oven has support columns which include flanges 12. Seated on the door frame 10 are latch hooks 31 which have an interior opening for engaging a crossbar 13 that, in turn, supports a locking mechanism 14 for the door 15.

FIGS. 1, 2, 3 and 4 illustrate an angularly-shaped packing strip 29 having an S-shaped cross-sectional configuration which is carried at its outwardly projecting side by the oven door 15 while its inwardly projecting side defines a sealing edge surface 18 for engagement with the door frame 10. A plurality of clamping plates 21 is arranged at spaced locations about the outer peripheral edge surface of the coke oven door and forms an important part to provide a new sealing arrangement for the door. Each of these clamping plates is held by a clamping bolt 19 extending through a slotted hole 20 in the plates and thence through a bore in the leg section of the U-shaped coke oven door. The extended free end of the bolt 19 receives a washer 19*a* and a nut 19*b*.

It is important to note that the slotted hole 20 in the clamping plate is arranged such that the enlarged dimension of the slotted hole extends in the same direction as the longitudinally-extending oven chamber. In this manner, the clamping plates may be positioned toward and away from the door frame 10 and thereby also the packing strip 29 which is clamped against the door by its seated relation within a slot 21*a* formed in the clamping plate 21. In order to exclude unintentional adjustment or movement of the clamping plates 21 after adjustments have been made, clamping bolts 17 are arranged to threadedly pass through nut members 16 attached to the door in a manner such that the bolts 17 extend in a direction parallel with the longitudinal direction of the coke oven chamber.

Extending perpendicularly to each of the clamping plates 21 there is provided an upper guide plate 22 and a lower guide plate 23 which are welded to the clamping plates. A push rod 30 extends through an opening in the guide plate 23 and into engagement with the center portion of the S-shaped packing strip 29. A collar 25 is secured to the push rod 30 for supporting one end of a spring 26. The push rod 30 has an extension rod 24 which projects through an opening in the upper guide plate 22 and serves to guide the push rod 30 and extension 24 during displacement under the resilient pressure developed by the spring 26. This pressure is resisted by a collar 27 slidably carried on the extension rod 24. The resilient force developed by the spring 26 can be changed by the insertion of spacer rings 28 between the collar 27 and the upper guide plate 22. In this manner, the force applied by the push rod 30 to the packing strip 29 can be selectively changed.

The adjustment of the sealing edge surface 18 relative to the door is accomplished by positioning the clamping plates 21 after heating of the ovens in a position such that the sealing edge 18 is approximately the same distance from the door frame throughout the entire periphery of the door. Bolt 19 and nut 19*b* are then torqued to hold the clamping plates firmly to the door. In the event leaks are observed at individual places at the periphery of the door, the pressure developed by spring 26 can be increased by the insertion of spacer rings 28 at these locations.

Figure 2:
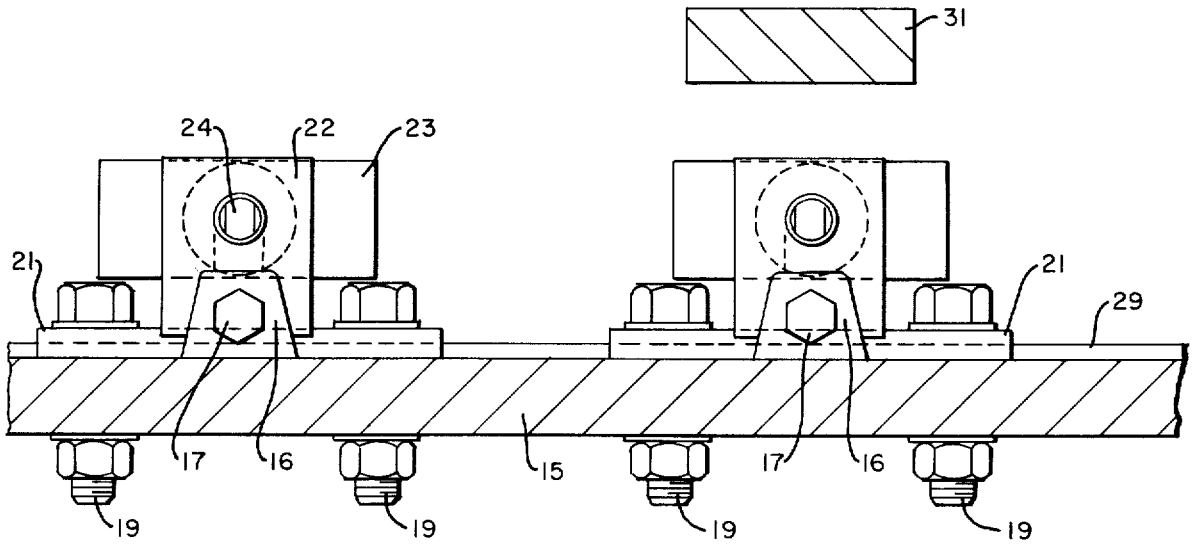
FIG. 2 is a sectional view taken along line II—II of FIG. 1.
Figure 3:
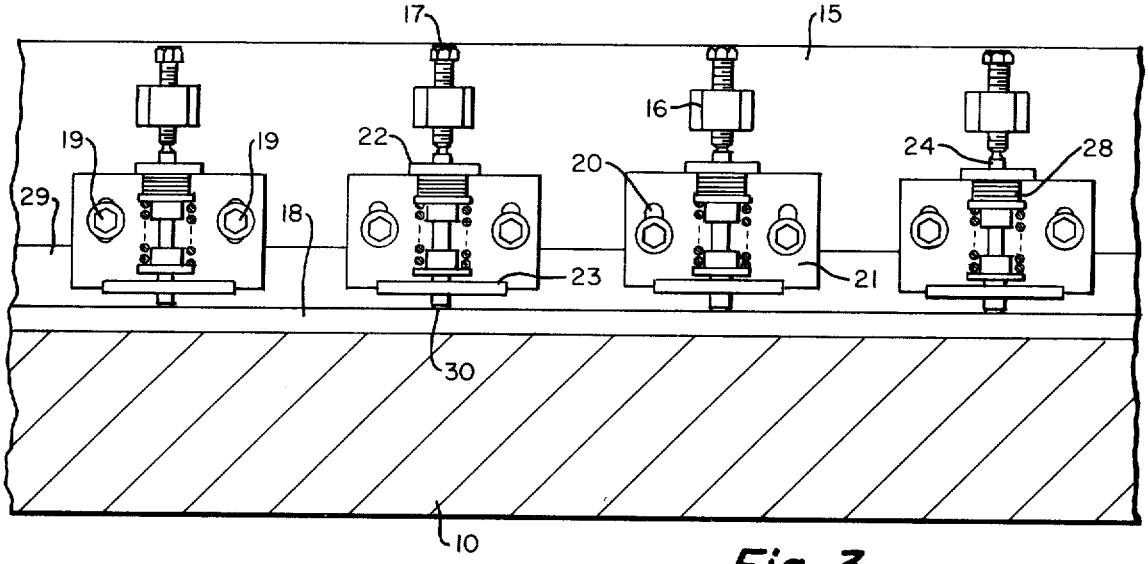
FIG. 3 is a sectional view taken along line III—III of FIG. 1.
Figure 4:
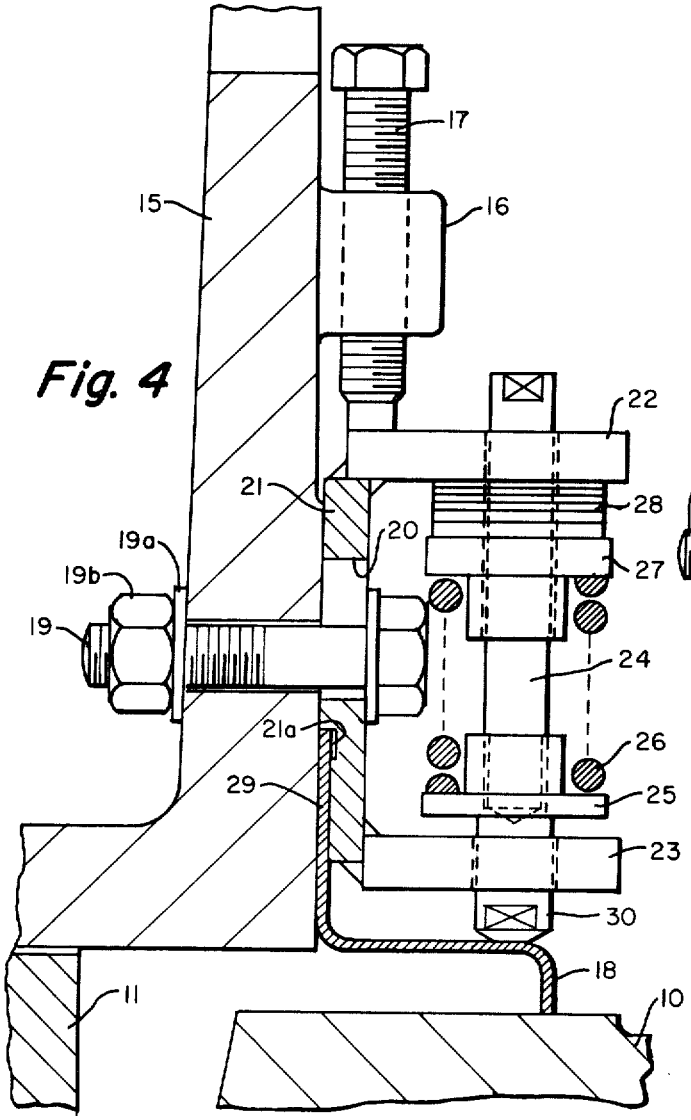
FIG. 4 is an enlarged view of the apparatus shown in FIG. 1 and illustrating in greater detail the packing strip and the structure provided for urging it into sealing contact with the door frame of the coke oven.
Figure 5:
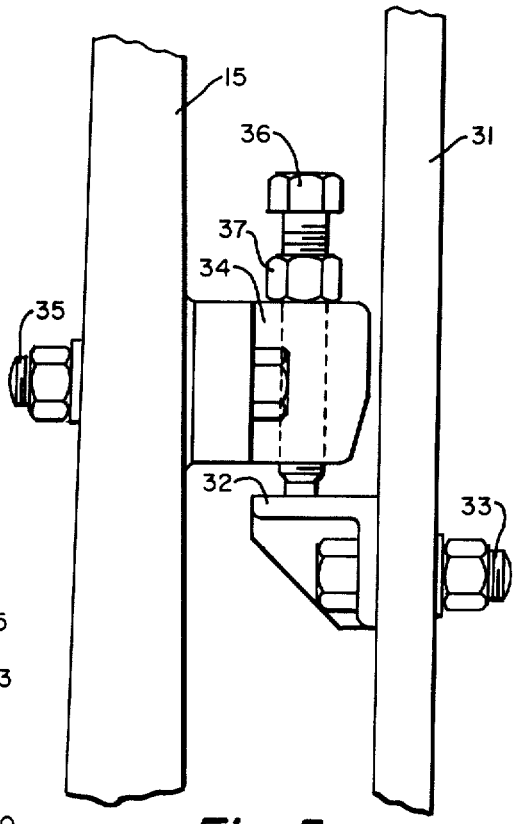
FIG. 5 is an elevational view similar to FIG. 1 but illustrating the arrangement of parts forming an adjustable stop between the door body and a door frame latch member.

In FIGS. 2 and 5, at opposite sides of the door is a latch 31 that extends from the door frame 10 in an essentially parallel relation with the extended legs of the U-shaped door 15. A stop 32 having an angular shape is connected to the latch 31 by means of a nut and bolt fastener 33. A threaded block 34 is secured to the door by means of a nut and bolt fastener 35. The block 34 has a tapped bore into which there is received a threaded bolt 36 which is secured in a desired position by a lock nut 37. Adjustments to the bolt 36 are made in a manner to limit displacement of the door toward the door jamb.

Thus, it will be observed that according to the present invention, the packing strip 29 is designed as an S-shaped angular section which is held at the door frame at one of its sides and positioned by the clamping plates 21 which are distributed at locations spaced about the periphery of the door. These clamping plates are adjustable in the longitudinal direction of the oven chamber and held in a fixed position to the door by means of the bolts 19. The extended edge of the packing strip defines a sealing edge 18 for contact with the door frame. The push rods 30 and extensions 24 guided by the guide plates 22 and 23 are urged by the spring 26 into contact with the sealing strip. These guide plates are, as shown, attached to the clamping plate 21 in their spaced-apart relation. Adjustments by the bolts 17 can be made in such a manner to automatically maintain support of the packing strip as the sealing edge thereof is displaced relative to the door frame and thereby accommodating varying dimensions produced due to the distortions of the door body as well as the door frame. The force developed by the springs can be increased by adding spacer elements 28 in the event that it is found that the pressure developed by the springs is not sufficient to displace the packing strip into contact with the door frame at any given point on the door's periphery. In order to assure that the elastically urged packing strip is not clamped during the initial placement of the door, stops 32 prevent excessive movement of the door toward the door frame. The effective position of the stops can be changed through adjusting the bolts 36.

Although the invention has been shown in connection with a certain specific embodiment, it will be readily apparent to those skilled in the art that various changes in form and arrangement of parts may be made to suit requirements without departing from the spirit and scope of the invention.

I claim as my invention:

1. A door structure in combination with a door frame surrounding an opening at an end of a longitudinally extending chamber of a coke oven, said door structure comprising:

a door forming an enclosure for the opening defined by said door frame;

a packing strip having an angular S-shape in respect to the transverse cross section thereof, said packing strip having one longitudinal edge arranged to extend along the peripheral surface of said door, said packing strip defining an extended edge resiliently arranged outwardly of the door for contact with said door frame, clamp means at closely spaced-apart locations about the periphery of said door for clamping said packing strip onto the door, said clamp means being arranged to engage the S-shaped packing strip only at the inner edge from which said extended edge is resiliently-arranged outwardly thereof, adjustable means carried by said door to position each of the clamp means and thereby adjust the extended edge surface of said packing strip relative to said door, guide means secured to said clamp means and movable therewith when adjusting the extended edge of the packing strip relative to the door, a push rod slideably supported by said guide means, and a resilient member for urging said push rod into engagement with said packing strip with a sufficient force to urge the resilient extended edge for the packing strip into a sealing relation with said door frame when the door defines an enclosure for the opening to the chamber of the coke oven.

2. The combination according to claim 1 wherein said clamp means are further defined to include a clamp plate having a recess therein facing said door for holding said packing strip adjacent said door.

3. The combination according to claim 2 wherein said clamp plate further includes a slotted hole having the enlarged dimension thereof extending in the longitudinal direction of the coke oven chamber, said combination further including bolt fastening means extending through said slotted hole for support by said door.

4. The combination according to claim 3 wherein said adjustable means includes a threaded bolt extending in the longitudinal direction of the coke oven chamber for engaging said clamp plate, said combination further including nut means projecting from said door for receiving said threaded bolt to adjustably position each clamp plate and thereby adjust the position of said packing strip relative to said door.

5. The combination according to claim 1 wherein said guide means are further defined to include:

a front guide plate secured to said clamp means for projecting from said door at a point adjacent said packing strip;

a rear guide plate secured to said clamp means for projecting from said door at a spaced location from said front guide plate;

said front and rear guide plates having aligned bores for slideably supporting said push rod;

a front collar secured to said push rod in spacedapart relation with said front guide plate;

a rear collar slideably carried by said push rod;

said resilient member being further defined as a spring disposed between said collars for displacing said push rod toward said packing strip; and spacer means positioned between said rear collar and said rear guide plate for adjustably positioning said rear collar while supporting said spring.

6. The combination according to claim 1 further comprising latch means supported by said door frame at points spaced therefrom and at opposite sides of said door, stop means carried by said latch means, and bolt means adjustably carried by said door for engaging said stop means to thereby locate said door relative to said door frame.

* * * * *